US007071766B2

(12) United States Patent
Nemoto

(10) Patent No.: US 7,071,766 B2
(45) Date of Patent: Jul. 4, 2006

(54) CONSTANT VOLTAGE GENERATING CIRCUIT

(75) Inventor: Kenji Nemoto, Sagamihara (JP)

(73) Assignee: Asahi Kasei Microsystems Co., Ltd., Tokyo (JP)

( * ) Notice: Subject to any disclaimer, the term of this patent is extended or adjusted under 35 U.S.C. 154(b) by 44 days.

(21) Appl. No.: 10/725,436

(22) Filed: Dec. 3, 2003

(65) Prior Publication Data

US 2004/0108888 A1 Jun. 10, 2004

(30) Foreign Application Priority Data

Dec. 4, 2002 (JP) ..... 2002-352812

(51) Int. Cl.
*G05F 1/46* (2006.01)

(52) U.S. Cl. ..... 327/539; 327/540; 323/313

(58) Field of Classification Search ..... 327/539, 327/540, 561, 563; 323/313; 330/256, 283
See application file for complete search history.

(56) References Cited

U.S. PATENT DOCUMENTS 4,896,094 A * 1/1990 Greaves et al. ..... 323/314
4,897,595 A 1/1990 Holle ..... 323/314
5,325,045 A * 6/1994 Sundby ..... 323/313
5,796,244 A 8/1998 Chen et al. ..... 323/313
6,362,612 B1 * 3/2002 Harris ..... 323/312
6,765,431 B1 * 7/2004 Coady ..... 327/539

FOREIGN PATENT DOCUMENTS

| | | |
|---|---|---|
| JP | 6-043956 | 2/1994 |
| JP | 8-044449 | 2/1996 |
| WO | WO 92/06424 | 4/1992 |

* cited by examiner

*Primary Examiner*—Timothy P. Callahan
*Assistant Examiner*—Terry L. Englund
(74) *Attorney, Agent, or Firm*—Finnegan Henderson Farabow Garrett & Dunner LLP

(57) ABSTRACT

A constant voltage generating circuit which uses a band gap reference circuit to produce a constant voltage and which is effective at reducing driving voltage and noise. The voltage generating circuit has a plurality of first bipolar transistors including n first bipolar transistors, each having an emitter area. The voltage generating circuit also includes a plurality of second bipolar transistors including n second bipolar transistors. Each of the n second bipolar transistors has an associated emitter area greater than the emitter area of each of the plurality of the first bipolar transistors. The constant voltage generating circuit produces a constant output voltage that is independent of temperature and the number of first and second transistors.

7 Claims, 6 Drawing Sheets

CONSTANT VOLTAGE GENERATING CIRCUIT

This application claims priority from Japanese Patent Application No. 2002-352812 filed Dec. 4, 2002, which is incorporated hereinto by reference.

BACKGROUND OF THE INVENTION

1. Field of the Invention

The present invention relates to a constant voltage generating circuit, and in particular, to a constant voltage generating circuit composed of a band gap reference circuit constructed on a semiconductor integrated circuit and which is effective in reducing a driving voltage and noise.

2. Description of the Related Art

FIG. 4 shows a conventionally well-known band gap reference circuit. The principle of the operation of this circuit utilizes the fact that a positive temperature characteristic is exhibited by the difference (ΔVBE) between the base emitter voltage (VBE) at a bipolar transistor PN21 having a negative temperature characteristic and the VBE at a bipolar transistor PN11 having a different emitter area (that is, N times as large as that of the bipolar transistor PN21). Thus, Formula 1 is realized in a circuit so as to obtain a flat temperature characteristic.

$$VOUT = \alpha\Delta VBE + VBE = \alpha\frac{\kappa T}{q}\ln(N) + VBE \cong 1.2\ \text{V} \tag{1}$$

κ: Boltzman constant q: electron load

T: temperature

α: 1+R2/R1

If the ratio of the area of the bipolar transistor PN21 to the area of the bipolar transistor PN11 is about 1:8, α (the voltage gain of a differential amplifier OP1) is about 13.

In view of the voltage gain of the differential amplifier OP1, since a PNP bipolar transistor is connected to the differential amplifier OP1 via a diode, the impedance between VSS and an emitter is low. Furthermore, an emitter terminal is considered to be substantially grounded, so that the differential amplifier is equivalent to an amplifying circuit having input resistance R1 and feedback resistance R2. Accordingly, the gain is (R1+R2)/R1=1+R2/R1=α. Given that noise from the differential amplifying circuit OP1 in input equivalent is defined as Vn, the noise characteristic is about αVn in output equivalent. Likewise, the offset voltage at the differential amplifier OP1 in input equivalent is a times in output equivalent.

For example, the circuits shown in FIGS. 5 and 6 are known to reduce noise (refer to, for example, Japanese Patent Application Laying-open No. 8-44449(1996)). The circuits in FIGS. 5 and 6 differ from each other in that one of them uses PNP bipolar transistors, while the other uses NPN bipolar transistors but their essential operations are equivalent to each other. The operations will be described below with reference to FIG. 6.

NPN transistors (NP11 to NP1*n*, NP21 to NP2*n*) having different emitter areas (in the present example, the ratio of the areas is N:1) are connected to two input terminals (+, −) of the differential amplifier OP1. Moreover, n NPN transistors are connected in series. Then, a potential difference ΔVBE occurs per stage, so that with the n NPN transistors, a potential difference nΔVBE occurs between both ends of R1. If PMOS FETs (P61, P62) have an equal W (channel width)/L (channel length) size, an equal current flows through the respective series NPN bipolar transistors. A voltage VOUT is expressed as follows:

$$VOUT = \alpha n\Delta VBE + nVBE = n(\alpha\Delta VBE + VBE) \cong 1.2\ nV \tag{2}$$

If this output is reduced to 1/n, a voltage of 1.2 V is obtained as in the case with the circuit in FIG. 4. In this case, α is almost equal to the α in FIG. 4.

The noise from the differential amplifier OP1 in input equivalent increases by a factor of α as in the case with the circuit in FIG. 4. Furthermore, an input/output gain is equivalent to that of the circuit in FIG. 4. Accordingly, if the output is multiplied by 1/n to obtain a voltage of 1.2V, the noise characteristic is 1/n compared to the circuit in FIG. 4. The use of the circuit in FIG. 6 reduces noise compared to the circuit in FIG. 4.

Similarly, another bandgap circuit is known to reduce noise (refer to, for example, FIGS. 1 to 3 in U.S. Pat. No. 5,796,244).

As described above, the circuits shown in FIGS. 5 and 6 are considered to be constant voltage generating circuits having a reduced noise characteristic. However, in this case, bipolar transistors must be stacked, and a voltage of (1.2×n) V must be generated and then multiplied by 1/n to obtain a voltage of 1.2 V. In this case, the circuit must be operated with a power supply voltage of (1.2×n) V or higher. Disadvantageously, it is difficult to simultaneously achieve a reduced voltage operation and reduced noise.

Furthermore, with a circuit such as the one described in U.S. Pat. No. 5,796,244, no feedback is provided by an output stage (a circuit detecting nΔVBE does not act as a feedback circuit). Consequently, changes in environment may preclude accurate outputs from being obtained.

Thus, the present invention is directed to providing a constant voltage generating circuit that solves the above problems.

SUMMARY OF THE INVENTION

The present invention provides a constant voltage generating circuit comprising a plurality of first pnp transistors including n (an integer; 2≦n) first pnp transistors, a collector of each of the plurality of first pnp transistors being grounded, a base of a first one of the plurality of first pnp transistors being grounded, a base of a k (an integer; 2≦k≦n)-th one of the plurality of first pnp transistors being connected to an emitter of a (k−1)-th one of the plurality of first pnp transistors; a plurality of second pnp transistors including n second pnp transistors, each having an emitter area greater than that of each of the plurality of first pnp transistors, a collector of each of the plurality of second pnp transistors being grounded, a base of a first one of the plurality of second pnp transistors being grounded, a base of a k-th one of the plurality of second pnp transistors, except for another one of the plurality of second pnp transistors, being connected to an emitter of a (k−1)-th one of the plurality of second pnp transistors; primary current sources connected to the respective emitters of said plurality of first pnp transistors and the respective emitters of said plurality of second pnp transistors, except for an emitter of the first one of the plurality of second pnp transistors, to supply currents to the respective pnp transistors of said pluralities of first and second pnp transistors, two resistors being connected in series between the emitter of said first one of the plurality of second pnp transistors and the corresponding primary current source, a connection point between the two resistors being connected to the base of said another one of the plurality of second pnp transistors; and current control means including a first input terminal to which the emitter of a n-th one of the plurality of first pnp transistors is connected and a second input terminal to which the emitter of a n-th one of the plurality of second pnp transistors is connected, the current control means controlling currents from the primary current sources by outputting a control signal that controls the currents from said primary current sources so that a potential at said first input terminal and a potential at said second input terminal are the same.

The present invention also provides a constant voltage generating circuit comprising a plurality of first npn transistors including n (an integer; $2 \leqq n$) first npn transistors, a base and a collector of each of the plurality of first npn transistors being connected together, an emitter of a first one of the plurality of first npn transistors being grounded, an emitter of a k (an integer; $2 \leqq k \leqq n$)-th one of the plurality of first npn transistors being connected to a collector of a (k−1)-th one of the plurality of first npn transistors; a plurality of second npn transistors including n second npn transistors, each having an emitter area greater than that of each of the plurality of first npn transistors, a base and a collector of each of said plurality of second npn transistors being connected together, an emitter of a first one of the plurality of second npn transistors being grounded, an emitter of a k (an integer; $2 \leqq k \leqq n$)-th one of the plurality of second npn transistors, except another one of the plurality of second npn transistors, being connected to a collector of a (k−1)-th one of the plurality of second npn transistors; primary current sources connected respectively to the collector of a n-th one of said plurality of first npn transistors and to the collector of a n-th one of the plurality of second npn transistors to supply currents to the respective npn transistors of the pluralities of first and second npn transistors, said first one of the plurality of second npn transistors being connected to a corresponding primary current source via two resistors connected in series, a connection point between the two resistors being connected to an emitter of said another one of the plurality of second npn transistors; and current control means including a first input terminal to which the collector of said n-th one of the plurality of first npn transistors is connected and a second input terminal to which the collector of said n-th one of the plurality of second npn transistors is connected, the current control means controlling currents from said primary current sources by outputting a control signal that controls the currents from said primary current sources so that a potential at the first input terminal and a potential at the second input terminal are the same.

The present invention also provides a constant voltage generating circuit wherein said current control means further comprises a differential voltage generating means which includes a differential amplifier including said first input terminal and said second input terminal and outputting said control signal, and an offset voltage at said differential amplifier in input equivalent has a primary temperature characteristic.

The present invention also provides a constant voltage generating circuit wherein said current control means comprises a differential amplifier including: at least one first bipolar transistor of a first polarity, having a collector, emitter, and base; at least one second bipolar transistor of said first polarity, having a collector, emitter, and base, said second bipolar transistor having an emitter area larger than that of said first bipolar transistor; the emitter-coflector path of said first bipolar transistor being connected in series between a first secondary current source and a node, and said base forming said first input terminal of said current control means; and the emitter-collector path of said second bipolar transistor being connected in series between a second secondary current source and said node, with the connection to said second secondary current source providing said control signal that controls said current for said primary current sources, and said base forming said second input terminal of said current control means.

The present invention also provides a constant voltage generating means wherein there are a plurality m of additional first bipolar transistors with their emitter-collector paths connected in series between the at least one first bipolar transistor and said node, and with the base of each connected to the side of the emitter-collector path of that transistor farthest from said node, and a plurality m of additional second bipolar transistors with their emitter-collector paths connected in series between the at least one second bipolar transistor and said node, and with the base of each connected to the side of the emitter-coflector path of that transistor farthest from said node.

The present invention also provides a constant voltage generating circuit wherein said current control means further comprises a differential amplifier having a differential pair including a first npn differential pair transistor and a second npn differential pair transistor having an emitter area larger than that of the first npn differential pair transistor, and another current source that supplies a current to said differential pair; wherein said differential pair includes said first and second input terminals, said first input terminal is a base of said first npn differential pair transistor and said second input terminal is a base of said second npn differential pair transistor, and wherein a collector of said first npn differential pair transistor is connected to said another current source, and a collector of said second differential pair npn transistor is connected to said another current source.

The present invention also provides a constant voltage generating circuit wherein said current control means further comprises a differential amplifier having a differential pair including a first npn differential pair transistor, a second npn differential pair transistor having an emitter area greater than that of the first npn differential pair transistor, first and second secondary current sources to supply current to said differential pair, and said differential amplifier has a plurality of third npn differential pair transistors including m (an integer; $1 \leqq m$) third npn differential pair transistors, and a plurality of fourth npn differential pair transistors including m fourth npn differential pair transistors each having an emitter area greater than that of the m third npn differential pair transistors; wherein said differential pair includes said first and second input terminals, said first input terminal being a base of said first npn differential pair transistor, and said second input terminal being a base of said second npn differential pair transistor; and wherein a collector of said first npn differential pair transistor is connected to said first secondary current source, and a collector of said second npn differential pair transistor is connected to said second secondary current source; wherein a base and a collector of each of said plurality of third npn differential pair transistors are connected together, a collector of a k (an integer; $2 \leqq k \leqq m$)-th one of the plurality of third npn differential pair transistors is connected to an emitter of a (k−1)-th one of the plurality of third npn differential pair transistors, and the collector of a first one of said plurality of third npn differential pair transistors is connected to the emitter of the first npn differential pair transistor constituting said differential pair;

and wherein a base and a collector of each of said plurality of fourth npn differential pair transistors are connected together, a collector of a k (an integer; $2 \leqq k \leqq m$)-th one of the plurality of fourth npn differential pair transistors is connected to an emitter of a (k−1)-th one of the plurality of fourth npn differential pair transistors, the collector of a first one of said plurality of fourth npn differential pair transistors is connected to the emitter of the second npn differential pair transistor constituting the differential pair, and the emitter of an m-th one of said plurality of fourth npn transistors is connected to the emitter of an m-th one of said plurality of third npn differential pair transistors.

As described above, according to the present invention, a constant voltage generating circuit is provided which can reduce a driving voltage and noise.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
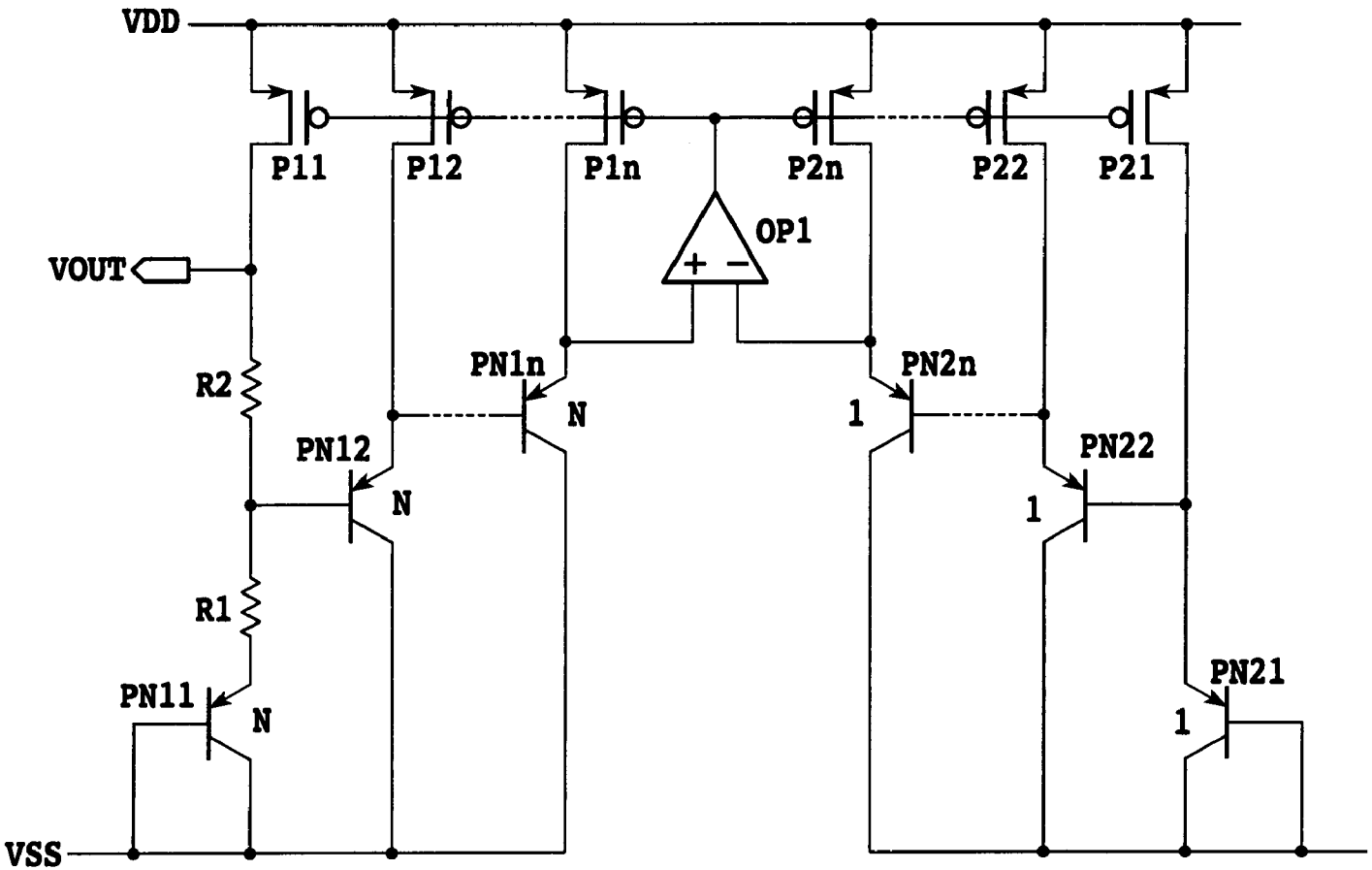
FIG. 1 is a circuit diagram showing an embodiment of the present invention.
Figure 3:
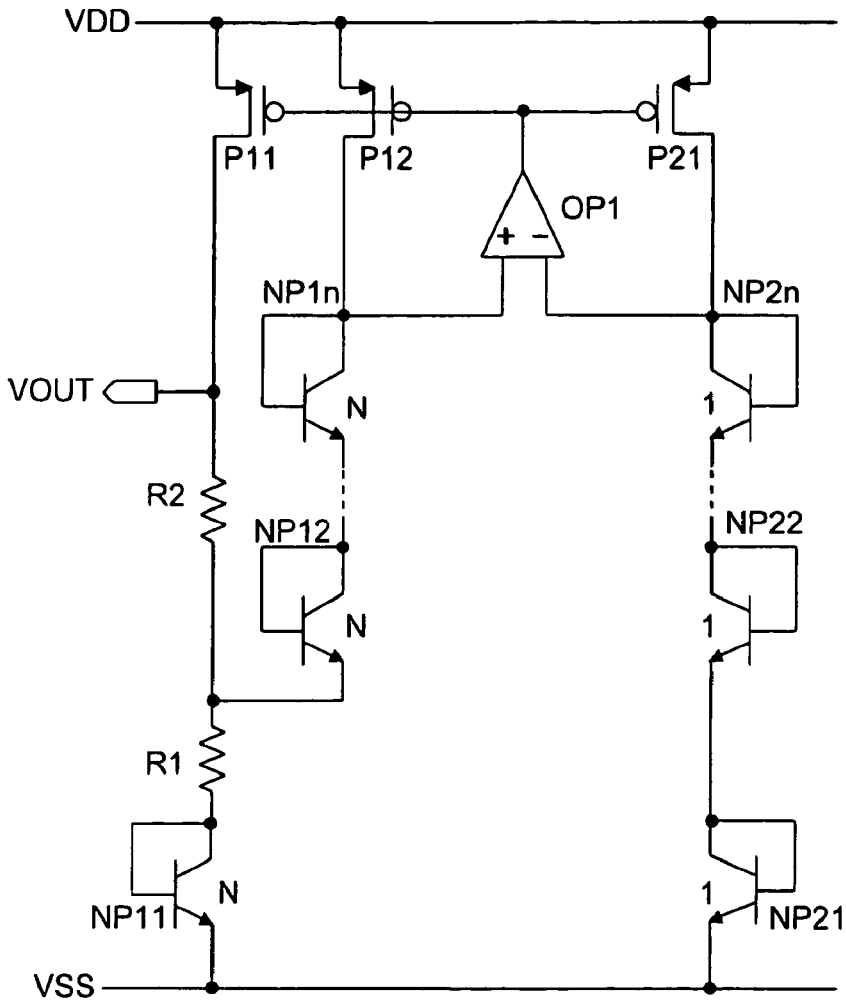
FIG. 3 is a circuit diagram showing another embodiment of the present invention.
Figure 4:
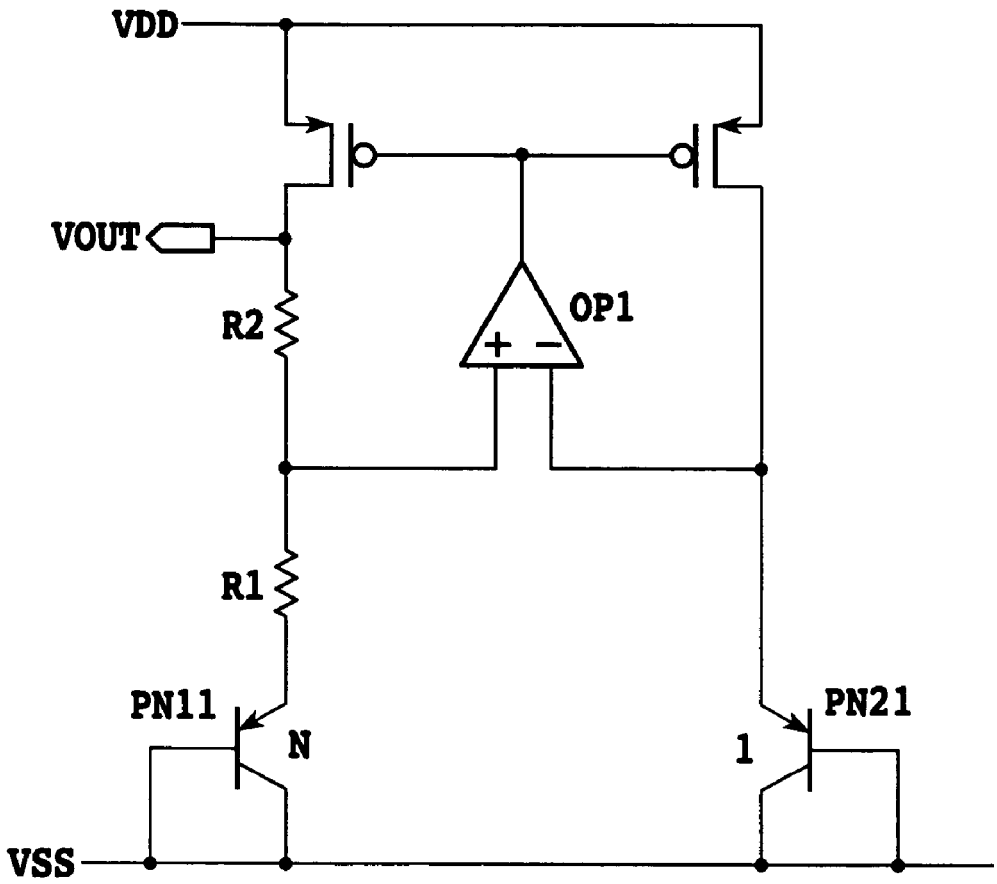
PRIOR ART FIG.4
FIG. 4 is a circuit diagram of a conventional band gap reference circuit.

FIG. 1 shows a first embodiment of the present invention (the circuits in FIGS. 1 and 3 differ from each other in that one of them uses pnp bipolar transistors, while the other uses npn bipolar transistors but their essential operations are equivalent to each other).

This constant voltage generating circuit comprises a group of first pnp transistors (PN21 to PN2*n*) composed of n (an integer; $2 \leqq n$) first pnp transistors, a group of second pnp transistors including n second pnp transistors (PN11 to PN1*n*) each having an emitter area N (an integer; $2 \leqq N$)-fold larger than that of the first pnp transistor, current sources (P11 to P1*n*, P21 to P2*n*) each of which supplies a current to a corresponding one of the groups of first and second pnp transistors, and a differential amplifier OP1 as current control means for controlling currents from the power sources.

A collector of each of the first pnp transistors is grounded. An emitter of each of the first pnp transistors is connected to the corresponding current source. A base of the first of the group of first pnp transistors PN21 is grounded. A base of the k (an integer; $2 \leqq k \leqq n$)-th of the group of first pnp transistors PN2*k* is connected to the emitter of the (k−1)-th of the group of first pnp transistors PN2(*k*−1). A collector of each of the group of second pnp transistors is grounded. An emitter of each of the group of second pnp transistors except the first PN11 of the second pnp transistors is connected to the corresponding current source. A base of the first of the group of second pnp transistors PN11 is grounded. A base of the k-th PN1*k* of the group of second pnp transistors except the second of the group of second pnp transistors PN12 is connected to the emitter of the (k−1)-th PN1(k−1) of the group of second pnp transistors. Two resistors R1 and R2 are connected in series between the emitter of the first PN11 of the second pnp transistors and the corresponding current source. The connection point between the two resistors connected in series is connected to the base of the second PN12 of the second pnp transistors.

A differential amplifier OP1 comprises a first input terminal (negative input terminal) to which the emitter of the n-th PN2*n* of the first pnp transistors and a second input terminal (positive input terminal) to which the emitter of the n-th PN1*n* of the second pnp transistors. The differential amplifier OP1 outputs a control signal that controls the currents from the current sources so that the potential at the first input terminal and the potential at the second input terminal are the same.

Figure 5:
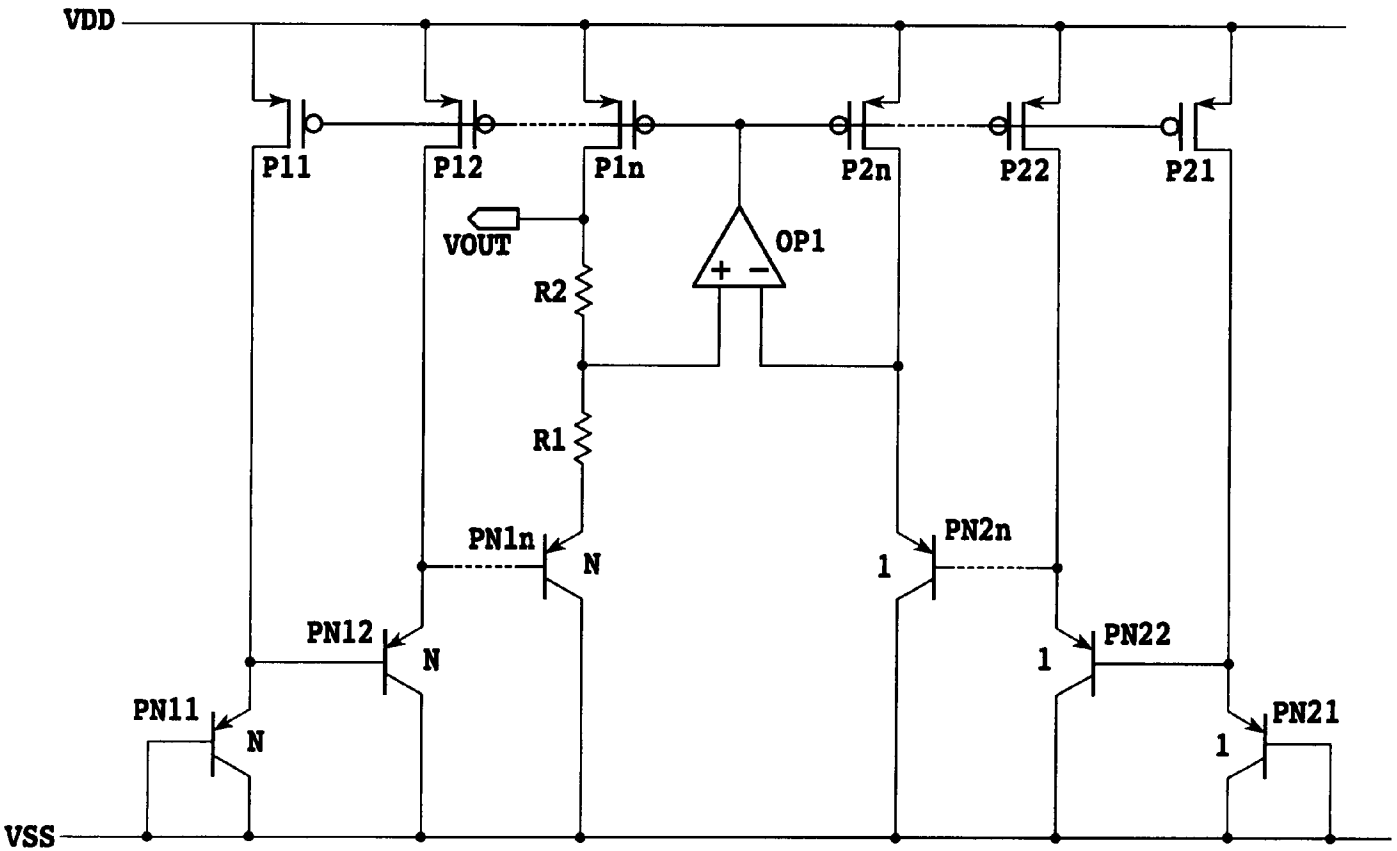
PRIOR ART FIG.5
FIG. 5 is a circuit diagram of a conventional band gap reference circuit.

This constant voltage generating circuit differs from the one in FIG. 5 in that the resistor R1 is interposed between the emitter of the second pnp transistor PN11 and the base of the second pnp transistor and that the resistor R2 is connected to the current source P11. The differential amplifier OP1 is used to constitute a feedback system. Accordingly, in operation, the voltage at the positive input terminal of the differential amplifier is the same as the voltage at the negative input terminal.

In this case, the voltages at the respective terminals are expressed as follows:

$$VPIN = VBE11 + VR1 + VBE12 + \ldots + VBE1n \quad (3)$$

$$VNIN = VBE21 + VBE22 + \ldots + VBE2n \quad (4)$$

Since VPIN=VNIN, the following formula is established.

$$VR1 = nVBE(1) - nVBE(N) \equiv n\Delta VBE \quad (5)$$

$$VBE(N) = VBE11 = \ldots = VBE1n$$

$$VBE(1) = VBE21 = \ldots = VBE2n$$

Thus, VOUT is expressed by Formula (6).

$$VOUT = VBE + \alpha' n\Delta VBE = 1.2\ \mathrm{V} \quad (6)$$

This eliminates the need for a circuit for reducing the required voltage to 1/n as required in the prior art. Furthermore, since $\alpha' n \cong \alpha$, $\alpha' \cong \alpha/n$. A voltage gain has a noise characteristic equivalent to that observed after the output from the circuit in FIG. 5 has been reduced to 1/n.

The prior art requires a power voltage of (1.2×n)V+the Von of the PMOS FET (current source P11) or higher. However, the present invention can operate with a power voltage of nVBE+the Von of the PMOS FET (current source P11). Thus, the required voltage is reduced.

Figure 2:
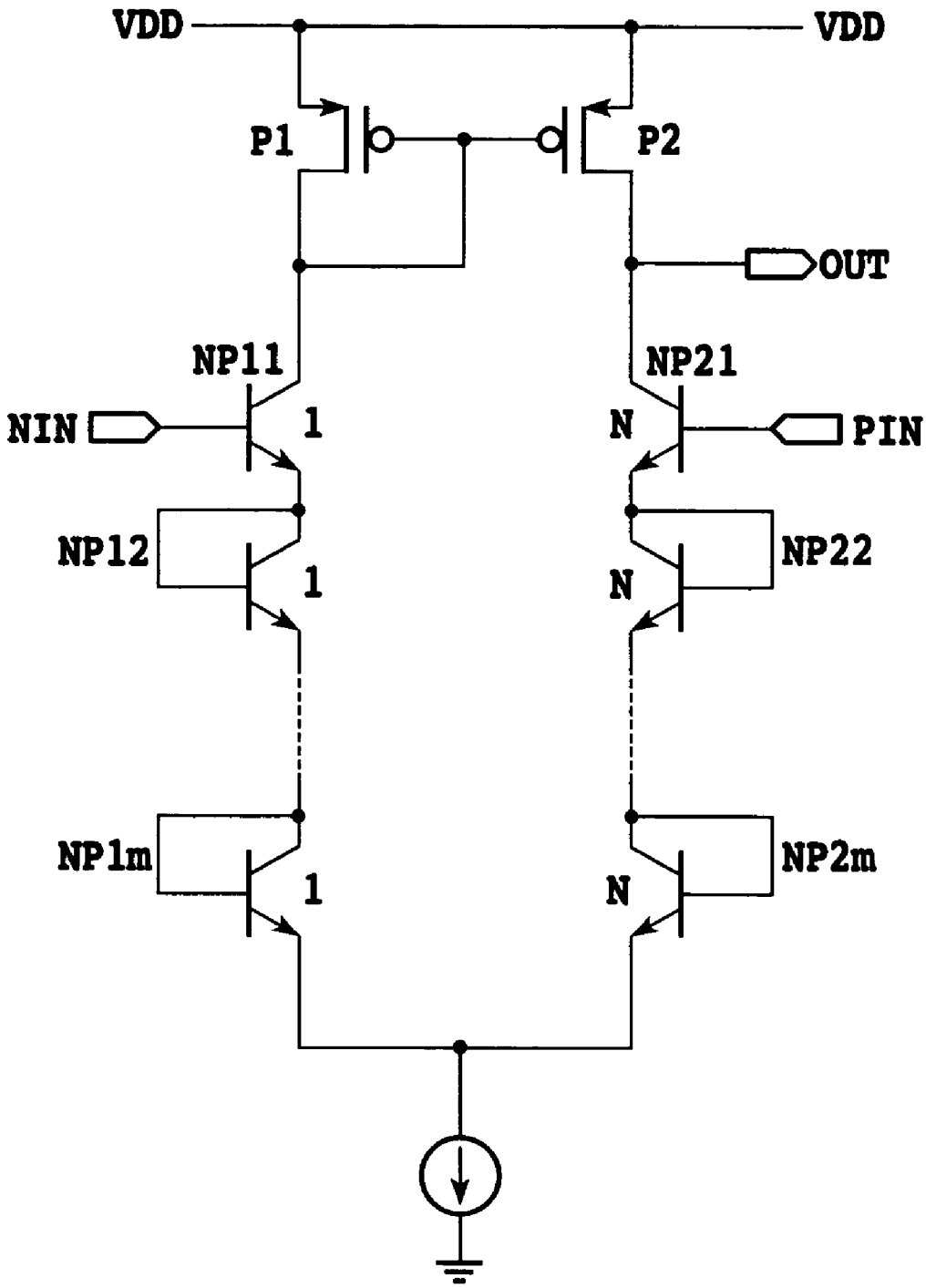
FIG. 2 is a circuit diagram showing an embodiment of a differential amplifier according to the present invention.

Then, an example of the differential amplifier is shown in FIG. 2.

This differential amplifier comprises a group of first npn transistors (NP11 to NP1*m*) composed of m (an integer; $2 \leqq m$) first npn transistors and a group of second npn transistors (NP21 to NP2*m*) composed of m second npn transistors each having an emitter area N (an integer; $2 \leqq N$)-fold larger than that of the first npn transistor, a differential pair composed of the first of the group of first npn transistors and the first of the group of second npn transistors, and a current source (P1, P2) that supplies a current to the differential pair.

The differential pair comprises a first input terminal NIN (negative input terminal) and a second input terminal PIN (positive input terminal). The first input terminal is a base of the first npn transistor NP11. The second input terminal is a base of the second npn transistor NP21.

A collector of the k (an integer; 2≦k≦m)-th NP1*k* of the group of first npn transistor is connected to an emitter of the (k−1)-th NP1(*k*−1) of the group of first npn transistors. A base and a collector of each first npn transistor NP1*k*are connected together. The emitter of the m-th NP1*m* of the group of first npn transistors is connected to the current source. A collector of the k (an integer; 2≦k≦m)-th NP2*k* of the group of second npn transistor is connected to an emitter of the (k−1)-th NP2(*k*−1) of the group of second npn transistors. A base and a collector of each second npn transistor NP2*k* are connected together. The emitter of the m-th NP2*m* of the group of second npn transistors is connected to the current source.

In this differential amplifier is used to constitute a feedback system, currents appearing on the right and left sides of the differential pair are almost the same. Accordingly, the feedback system is stable. In this case, the voltages at the terminals NIN and PIN are considered using, as a reference, the node to which the emitters of the transistors NP1*m* and NP2*m* are connected. The following formulae are given.

$$VNIN=mVBE.(1)$$

$$VPIN=mVBE(N)$$

Thus, the potential difference ΔVIN between the voltages VPIN and VNIN is expressed as follows:

$$\Delta VIN=m\Delta VBE$$

The potential difference has an offset voltage in input equivalent corresponding to the primary temperature characteristic.

If this differential amplifier is used for the circuit in FIG. 1, the voltage applied to the resistor R1 is nΔVBE+ΔVIN=(n+m)ΔVBE. Thus, VOUT is expressed as follows:

$$VOUT=VBE+\alpha''(n+m)\Delta VBE=1.2\ V$$

Consequently, α"=α/(n+m), thus further reducing the voltage gain.

Figure 6:
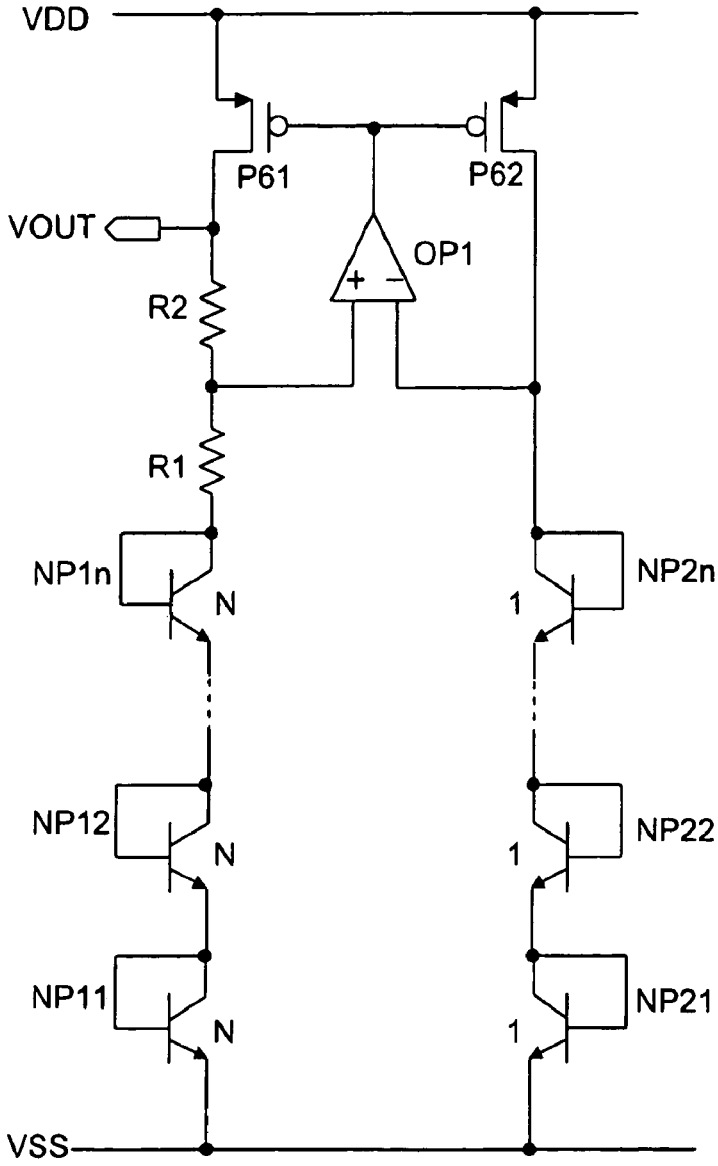
PRIOR ART FIG. 6
FIG. 6 is a circuit diagram of a conventional band gap reference circuit.

As a result, operations can be preformed with a power voltage equivalent to that used in the embodiment shown in FIG. 1, and the noise characteristic can be improved. Therefore, operations can be performed with a reduced voltage and noise can be reduced, compared to the prior art. If this differential amplifier is used for the circuit in FIG. 3, and in FIGS. 5 and 6, the noise characteristic can also be improved.

As described above, according to the present invention, a constant voltage generating circuit can be provided which can reduce a driving voltage and noise.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A constant voltage generating circuit comprising:

a plurality of first pnp transistors including n (an integer; 2≦n) first pnp transistors, a collector of each of the plurality of first pnp transistors being grounded, a base of a first one of the plurality of first pnp transistors being grounded, a base of a k (an integer; 2≦k≦n)-th one of the plurality of first pnp transistors being connected to an emitter of a (k−1)-th one of the plurality of first pnp transistors;

a plurality of second pnp transistors including n second pnp transistors, each having an emitter area greater than that of each of the plurality of first pnp transistors, a collector of each of the plurality of second pnp transistors being grounded, a base of a first one of the plurality of second pnp transistors being grounded, a base of a k-th one of the plurality of second pnp transistors, except for another one of the plurality of second pnp transistors, being connected to an emitter of a (k−1)-th one of the plurality of second pnp transistors;

primary current sources connected to the respective emitters of said plurality of first pnp transistors and the respective emitters of said plurality of second pnp transistors, except for an emitter of the first one of the plurality of second pnp transistors, to supply currents to the respective pnp transistors of said pluralities of first and second pnp transistors, two resistors being connected in series between the emitter of said first one of the plurality of second pnp transistors and the corresponding primary current source, a connection point between the two resistors being connected to the base of said another one of the plurality of second pnp transistors; and current control means including a first input terminal to which the emitter of a n-th one of the plurality of first pnp transistors is connected and a second input terminal to which the emitter of a n-th one of the plurality of second pnp transistors is connected, the current control means controlling currents from the primary current sources by outputting a control signal that controls the currents from said primary current sources so that a potential at said first input terminal and a potential at said second input terminal are the same.

2. A constant voltage generating circuit comprising:

a plurality of first npn transistors including n (an integer; 2≦n) first npn transistors, a base and a collector of each of the plurality of first npn transistors being connected together, an emitter of a first one of the plurality of first npn transistors being grounded, an emitter of a k (an integer; 2≦k≦n)-th one of the plurality of first npn transistors being connected to a collector of a (k−1)-th one of the plurality of first npn transistors;

a plurality of second npn transistors including n second npn transistors, each having an emitter area greater than that of each of the plurality of first npn transistors, a base and a collector of each of said plurality of second npn transistors being connected together, an emitter of a first one of the plurality of second npn transistors being grounded, an emitter of a k (an integer; 2≦k≦n)-th one of the plurality of second npn transistors, except another one of the plurality of second npn transistors, being connected to a collector of a (k−1)-th one of the plurality of second npn transistors;

primary current sources connected respectively to the collector of a n-th one of said plurality of first npn transistors and to the collector of a n-th one of the plurality of second npn transistors to supply currents to the respective npn transistors of the pluralities of first and second npn transistors, said first one of the plurality of second npn transistors being connected to a corresponding primary current source via two resistors connected in series, a connection point between the two resistors being connected to an emitter of said another one of the plurality of second npn transistors; and current control means including a first input terminal to which the collector of said n-th one of the plurality of first npn transistors is connected and a second input terminal to which the collector of said n-th one of the plurality of second npn transistors is connected, the current control means controlling currents from said primary current sources by outputting a control signal that controls the currents from said primary current sources so that a potential at the first input terminal and a potential at the second input terminal are the same.

3. The constant voltage generating circuit as claimed in claim 1 or 2, wherein said current control means further comprises a differential voltage generating means which includes a differential amplifier including said first input terminal and said second input terminal and outputting said control signal, and an offset voltage at said differential amplifier in input equivalent has a primary temperature characteristic.

4. The constant voltage generating circuit as claimed in any of claim 1 or 2, wherein said current control means further comprises a differential amplifier having a differential pair including a first npn differential pair transistor and a second npn differential pair transistor having an emitter area larger than that of the first npn differential pair transistor, and another current source that supplies a current to said differential pair;

wherein said differential pair includes said first and second input terminals, said first input terminal is a base of said first npn differential pair transistor and said second input terminal is a base of said second npn differential pair transistor; and wherein a collector of said first npn differential pair transistor is connected to said another current source, and a collector of said second differential pair npn transistor is connected to said another current source.

5. The constant voltage generating circuit as claimed in claim 1 or 2, wherein said current control means further comprises a differential amplifier having a differential pair including a first npn differential pair transistor, a second npn differential pair transistor having an emitter area greater than that of the first npn differential pair transistor, first and second secondary current sources to supply current to said differential pair, and said differential amplifier has a plurality of third npn differential pair transistors including m (an integer; $1 \leqq m$) third npn differential pair transistors, and a plurality of fourth npn differential pair transistors including m fourth npn differential pair transistors each having an emitter area greater than that of the m third npn differential pair transistors;

wherein said differential pair includes said first and second input terminals, said first input terminal being a base of said first npn differential pair transistor, and said second input terminal being a base of said second npn differential pair transistor; and wherein a collector of said first npn differential pair transistor is connected to said first secondary current source, and a collector of said second npn differential pair transistor is connected to said second secondary current source;

wherein a base and a collector of each of said plurally of third npn differential pair transistors are connected together, a collector of a k (an integer; $2 \leqq k \leqq m$)-th one of the plurality of third npn differential pair transistors is connected to an emitter of a (k−1)-th one of the plurality of third npn differential pair transistors, and the collector of a first one of said plurality of third npn differential pair transistors is connected to the emitter of the first npn differential pair transistor constituting said differential pair; and wherein a base and a collector of each of said plurality of fourth npn differential pair transistors are connected together, a collector of a k (an integer; $2 \leqq k \leqq m$)-th one of the plurality of fourth npn differential pair transistors is connected to an emitter of a (k−1)-th one of the plurality of fourth npn differential pair transistors, the collector of a first one of said plurality of fourth npn differential pair transistors is connected to the emitter of the second npn differential pair transistor constituting the differential pair, and the emitter of an m-th one of said plurality of fourth npn transistors is connected to the emitter of an m-th one of said plurality of third npn differential pair transistors.

6. The constant voltage generating circuit of claim 1 or 2 wherein said current control means comprises a differential amplifier including:

at least one first bipolar transistor of a first polarity, having a collector, emitter, and base;

at least one second bipolar transistor of said first polarity, having a collector, emitter, and base, said second bipolar transistor having an emitter area larger than that of said first bipolar transistor;

the emitter-collector path of said first bipolar transistor being connected in series between a first secondary current source and a node, and said base forming said first input terminal of said current control means; and the emitter-collector path of said second bipolar transistor being connected in series between a second secondary current source and said node, with the connection to said second secondary current source providing said control signal that controls said current for said primary current sources, and said base forming said second input terminal of said current control means.

7. The constant voltage generating means of claim 6 wherein there are a plurality m of additional first bipolar transistors with their emitter-collector paths connected in series between the at least one first bipolar transistor and said node, and with the base of each connected to the side of the emitter-collector path of that transistor farthest from said node, and a plurality m of additional second bipolar transistors with their emitter-collector paths connected in series between the at least one second bipolar transistor and said node, and with the base of each connected to the side of the emitter-collector path of that transistor farthest from said node.

* * * * *

UNITED STATES PATENT AND TRADEMARK OFFICE

CERTIFICATE OF CORRECTION

PATENT NO. : 7,071,766 B2
APPLICATION NO. : 10/725436
DATED : July 4, 2006
INVENTOR(S) : Kenji Nemoto It is certified that error appears in the above-identified patent and that said Letters Patent is hereby corrected as shown below:

Claim 4, column 9, line 20, “claim” should read --claims--.

Claim 5, column 10, line 1, “plurally” should read --plurality--.

Signed and Sealed this

Thirteenth Day of February, 2007

JON W. DUDAS
*Director of the United States Patent and Trademark Office*